US012312940B2

(12) United States Patent
Rao et al.

(10) Patent No.: US 12,312,940 B2
(45) Date of Patent: May 27, 2025

(54) HYBRID ESP FAILURE PREDICTION USING FUZZY LOGIC FOR DATA IMPROVEMENT AND AUGMENTATION

(71) Applicant: Landmark Graphics Corporation, Houston, TX (US)

(72) Inventors: Ailneni Rakshitha Rao, Bangalore (IN); Shashwat Verma, Bangalore (IN); Geetha Nair, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 83 days.

(21) Appl. No.: 18/379,067

(22) Filed: Oct. 11, 2023

(65) Prior Publication Data

US 2025/0122794 A1 Apr. 17, 2025

(51) Int. Cl.
*E21B 47/008* (2012.01)

(52) U.S. Cl.
CPC ..... *E21B 47/008* (2020.05); *E21B 2200/20* (2020.05); *E21B 2200/22* (2020.05)

(58) Field of Classification Search
CPC . E21B 47/008; E21B 2200/20; E21B 2200/22
USPC ..... 340/679
See application file for complete search history.

(56) References Cited

U.S. PATENT DOCUMENTS 6,343,656 B1 2/2002 Vazquez et al.
9,261,097 B2 2/2016 Moricca et al.
10,429,533 B2 10/2019 Noui-Mehidi et al.
11,480,039 B2 * 10/2022 Beck ..... F04B 47/06
2014/0039836 A1 2/2014 Moricca et al.
2019/0317488 A1 * 10/2019 Al-Maghlouth ... G05B 23/0275
2021/0049510 A1 2/2021 Adjaoute
(Continued)

FOREIGN PATENT DOCUMENTS

CN 111461551 A 7/2020
CN 112785091 A 5/2021
WO 2019199433 A1 10/2019

OTHER PUBLICATIONS

Foreign Communication from Related Application—International Search Report and Written Opinion of the International Searching Authority, International Application No. PCT/US2023/035284, dated Jul. 3, 2024, 10 pages.

*Primary Examiner* — Kerri L McNally
(74) *Attorney, Agent, or Firm* — Conley Rose, P.C.; Rodney B. Carroll

(57) ABSTRACT

Systems and methods are described using a trained ML model to monitor, detect failure within, and schedule a remediation procedure (RP) for an operating ESP within a well. ESP status data including a time series comprising ESP input variables representing ESP state are collected from a sensor. Using fuzzy logic, the ESP status data is cleaned to remove abnormal data and used to generate fuzzy logic-based labels, each representing an ESP condition associated with ESP state. The fuzzy logic-based labels are segregated into processed labels used to populate each ML model feature. A selected, trained ML model with improved accuracy for ESP monitoring, failure detection, and RP scheduling for the ESP (based on specific ML model, well, and ESP), accepts the ML model features as input. An ESP failure alert is generated by the ML model based on the ESP status data. The RP is scheduled before ESP catastrophic failure.

20 Claims, 9 Drawing Sheets

(56) References Cited

U.S. PATENT DOCUMENTS

| | | | | |
|---|---|---|---|---|
| 2021/0166184 | A1* | 6/2021 | Fahham | G06Q 10/0631 |
| 2021/0222552 | A1* | 7/2021 | Gao | E21B 41/00 |
| 2022/0221826 | A1* | 7/2022 | Nguyen | G05D 7/0676 |
| 2023/0107580 | A1* | 4/2023 | Gandikota | G06N 5/04 700/28 |
| 2023/0212937 | A1* | 7/2023 | Pang | E21B 47/008 166/250.01 |
| 2024/0062134 | A1* | 2/2024 | Altoukhi | G06Q 10/06393 |
| 2024/0328303 | A1* | 10/2024 | Arukhe | E21B 47/008 |

* cited by examiner

400

| | 450 Condition | 460 Time Frame |
|---|---|---|
| 402 | Partially closed Surface Valve during operation | 1 hour |
| 404 | Pump off | 1 hour |
| 406 | Gas lock | 1 hour |
| 408 | Pump slow down | 1 hour |
| 410 | Emulsion or solid production | 24 hours |
| 412 | Tubing Plug | 24 hours |
| 414 | Intake Plug | 24 hours |
| 416 | Production Fluid Density increase | 24 hours |
| 418 | Broken Shaft | 30 minutes |
| 420 | Rotation reversed during operation | 30 minutes |
| 422 | ADV Leak | 1 week |
| 424 | Pump Wear | 1 week |
| 426 | Pump Speed up | 1 hour |
| 428 | Open Chock | 1 hour |

*FIG. 4*

HYBRID ESP FAILURE PREDICTION USING FUZZY LOGIC FOR DATA IMPROVEMENT AND AUGMENTATION

BACKGROUND

Oil field operators dedicate significant resources to improve the recovery of hydrocarbons from reservoirs while reducing recovery costs. To achieve these goals, reservoir engineers both monitor the current state of the reservoir and attempt to predict future behavior given a set of current and/or postulated conditions.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 4 is an illustration of a data chart of ESP conditions according to an embodiment of the disclosure.

DETAILED DESCRIPTION

Figure 1:
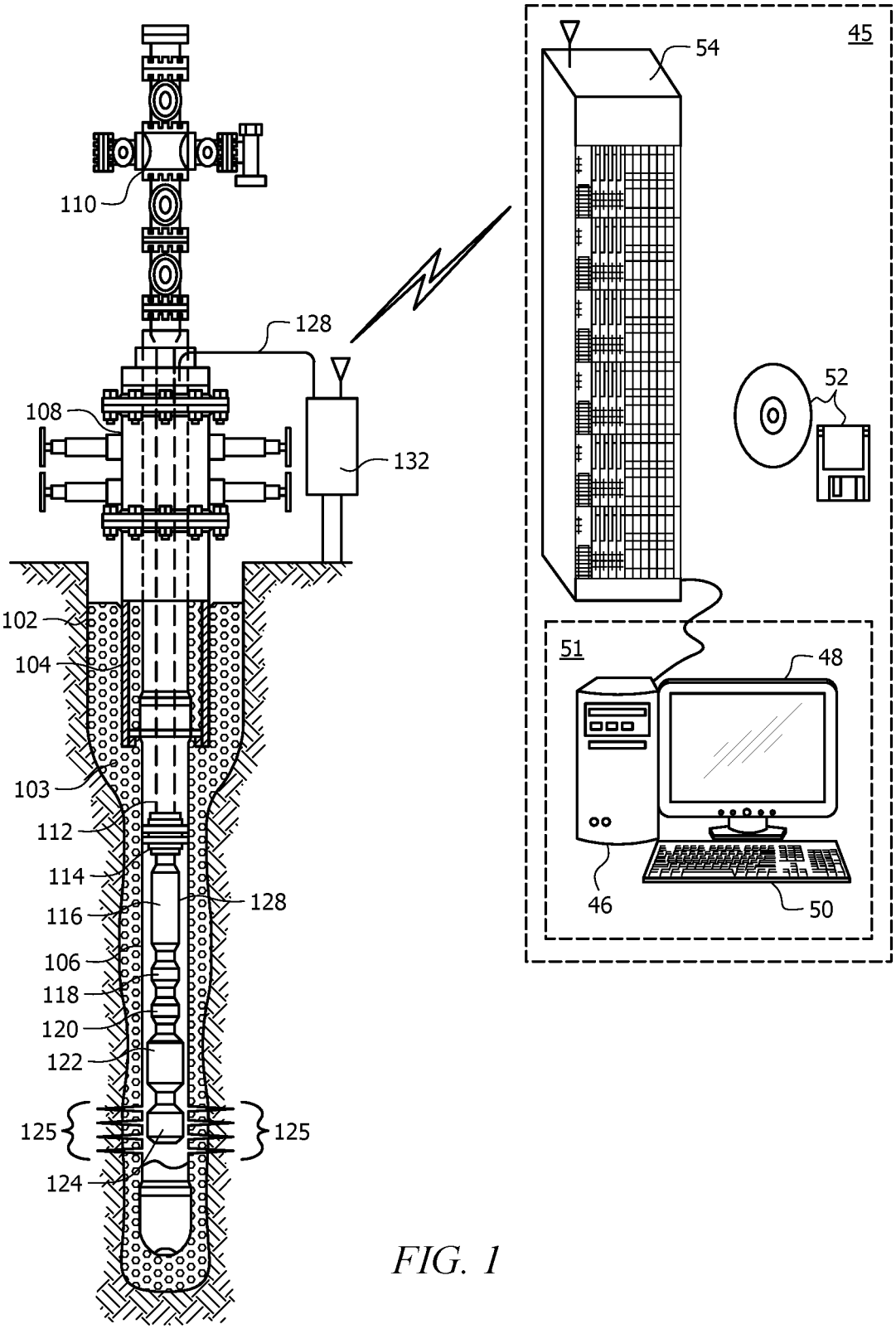
FIG. 1 is an illustration of a production well that sources measured well and electric submersible pump (ESP) data according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Conditions within a well can be monitored, and the equipment used to extract product from the well can also be monitored. Such monitoring ensures that the equipment is functioning as close to its optimal operating point as possible or practical, and that failures are detected and resolved promptly. One type of equipment used downhole to extract product from oil and gas wells is an electric submersible pump (ESP). ESPs are generally mounted in line with the production tubing where they are submerged within the product present within the well when the tubing is lowered into the well's production casing. ESPs both pump the product to the surface and lower the flowing bottom hole pressure (FBHP). The decrease in FBHP increases the pressure differential between the formation and the well and accelerates the movement of product from the formation into the well through perforations in the casing.

Power to drive an ESP is provided from the surface via cables that also provide conductors for signals to be received from the ESP at the surface. Data transmitted to the surface may include, but is not limited to, motor temperature, motor drive current frequency, pump intake pressure and pump discharge pressure. Although the data provided enables monitoring of the performance of an ESP determining the underlying cause of a failure or a variation in the performance of an ESP is a more complicated task. A given ESP failure or performance variation can have numerous causes and operators strive to identify the cause of such conditions quickly to reduce any resulting downtime or reduced production. While experienced reservoir personnel may rely on their personal experience to diagnose and resolve such conditions, a more automated approach based on a broader information base offers the possibility of diagnosing conditions and providing more optimal solutions in a shorter period of time. A given ESP failure or performance variation can have numerous causes, so it is important to identify problematic conditions and predict failures before they occur to reduce any resulting downtime or reduced production.

However, contemporary, known current data-driven approaches for ESP failure prediction using only machine learning (ML) models rely solely on training models without leveraging other information to enhance the accuracy of the ML models. Raw ESP data often contains abnormal data points which, if not accounted for, reduce the accuracy of ML models tasked with failure prediction.

The present disclosure generally relates to at least failure detection and maintenance of an operational ESP. More particularly, embodiments are directed to at least using a trained machine learning (ML) model utilizing fuzzy logic-based labels for data improvement and augmentation to monitor, detect a failure within, and schedule a remediation procedure for an operating ESP. Embodiments discussed herein increase the accuracy of failure prediction in operating ESPs by combining a data-driven ML model with generated fuzzy logic labels configured to indicate specific ESP conditions that are predictors of catastrophic failure of an operating ESP. Generating fuzzy-logic based labels as described herein adds context to the raw ESP data and at least reduces incorrect failure predictions—both false positives and false negatives—during ML model training and when the ML model is deployed in field work by cleaning the raw ESP data. Such fuzzy logic labels are also usable as additional ML features for the ML model. Embodiments herein thus use a hybrid approach to combine data-driven predictive ML model with a rule-based fuzzy logic system to increase the accuracy of ESP failure prediction, while the ESP is operating in place. This reduces downtime and lowers production costs by enabling operating ESPs to more frequently be scheduled for remediation procedures before a catastrophic failure occurs.

The systems and methods described herein operate on measured data collected from wells within a reservoir, such as those found in oil and gas production fields. Such fields generally include multiple producer wells that provide access to the reservoir fluids underground. Measured well data is collected regularly from each producer well to track changing conditions in the reservoir. FIG. 1 shows an example of a producer well with a borehole 102 that has been drilled into the earth. In some embodiments, such boreholes are routinely drilled to ten thousand feet or more in depth and can be steered horizontally for perhaps twice that distance. The producer well also includes a casing header 104 and casing 106, both secured into place by cement 103. Blowout preventer (BOP) 108 couples to casing header 106 and production wellhead 110, which together seal in the well head and enable fluids to be extracted from the well in a safe and controlled manner.

The use of measurement devices permanently installed in the well along with the ESP facilitates monitoring and control of an ESP system. The different transducers send signals to the surface that may be stored, evaluated and used to control the ESP system's operations. Measured well data is periodically sampled and collected from the producer well and combined with measurements from other wells within a reservoir, enabling the overall state of the reservoir to be monitored and assessed. These measurements may be taken using a number of different downhole and surface instruments, including but not limited to, temperature and pressure sensor 118 and flow meter 120. Additional devices also coupled in-line to production tubing 112 include downhole valve or choke 116 (used to vary the fluid flow restriction), ESP 122 (for example a centrifugal pump which via an inlet draws in fluid flowing from perforations 125 outside ESP 122 and discharges the fluid at increased pressure into the production tubing 112), ESP motor 124 (driving ESP 122), and packer 114 (isolating the production zone below the packer from the rest of the well). Additional surface measurement devices may be used to measure, for example, the tubing head pressure and the electrical power consumption of ESP motor 124.

Each of the devices along production tubing 112 couples to cable 128, which is attached to the exterior of production tubing 112 and is run to the surface through blowout preventer 108 where it couples to control panel 132. Cable 128 provides power to the devices to which it couples, and further provides signal paths (electrical, optical, etc.,) that enable control signals to be directed from the surface to the downhole devices, and for telemetry signals to be received at the surface from the downhole devices. The devices may be controlled and monitored locally by field personnel using a user interface built into control panel 132, or may be controlled and monitored by a computer system 45. Communication between control panel 132 and computer system 45 may be via a wireless network (e.g., a cellular network), via a cabled network (e.g., a cabled connection to the Internet), or a combination of wireless and cabled networks. Computer system 45 may be located proximate the wellsite (e.g., in a control building), remote from the wellsite (e.g., at a central or regional well monitoring location or office), or a combination thereof.

In at least some illustrative embodiments, data is also collected using a production logging tool, which may be lowered by cable into production tubing 112. In other illustrative embodiments, production tubing 112 is first removed, and the production logging tool is then lowered into casing 106. In either case, the tool is subsequently pulled back up while measurements are taken (e.g., during run-in, run-out, or both) as a function of borehole position and azimuth angle. In other alternative embodiments, an alternative technique that is sometimes used is logging with coil tubing, in which a production logging tool is coupled to the end of coil tubing pulled from a reel and pushed downhole by a tubing injector positioned at the top of production wellhead 110. As before, the tool may be pushed down either production tubing 112 or casing 106 after production tubing 112 has been removed. Regardless of the technique used to introduce and remove it, the production logging tool provides additional data that can be collected (e.g., during run-in, run-out, or both) and used to supplement data collected from the production tubing and casing measurement devices. The production logging tool data may be communicated to computer system 45 during the logging process (e.g., real-time data transmission), or alternatively may be downloaded from the production logging tool after the tool assembly is retrieved.

Continuing to refer to the example of FIG. 1, control panel 132 includes a remote terminal unit (RTU) which collects the data from the downhole measurement devices and forwards it to a supervisory control and data acquisition (SCADA) system that is part of computer system 45. In the illustrative embodiment shown, computer system 45 includes a set of blade servers 54 with several processor blades, at least some of which provide the above-described SCADA functionality. Other processor blades may be used to implement the disclosed ESP monitoring, diagnosing and optimizing. Computer system 45 also includes user workstation 51, which includes a general processing system 46. Both the processor blades of blade server 54 and general processing system 46 are preferably configured by software, shown in FIG. 1 in the form of removable, non-transitory (i.e., non-volatile) information storage media 52, to process collected well and ESP data. The software may also be downloadable software accessed through a network (e.g., via the Internet). General processing system 46 couples to a display device 48 and a user-input device 50 to enable a human operator to interact with the system software 52. Alternatively, display device 48 and user-input device 50 may couple to a processor blade within blade server 54 that operates as general processing system 46 of user workstation 51.

Figure 2A:
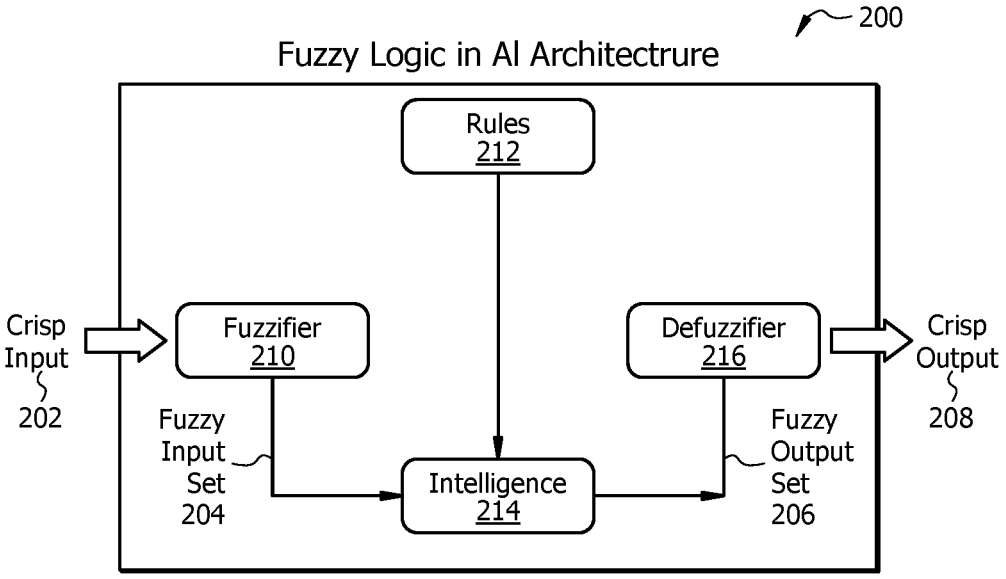
FIG. 2A is an illustration of a fuzzy logic workflow suitable for integration into an ML architecture according to an embodiment of the disclosure.
Figure 2B:
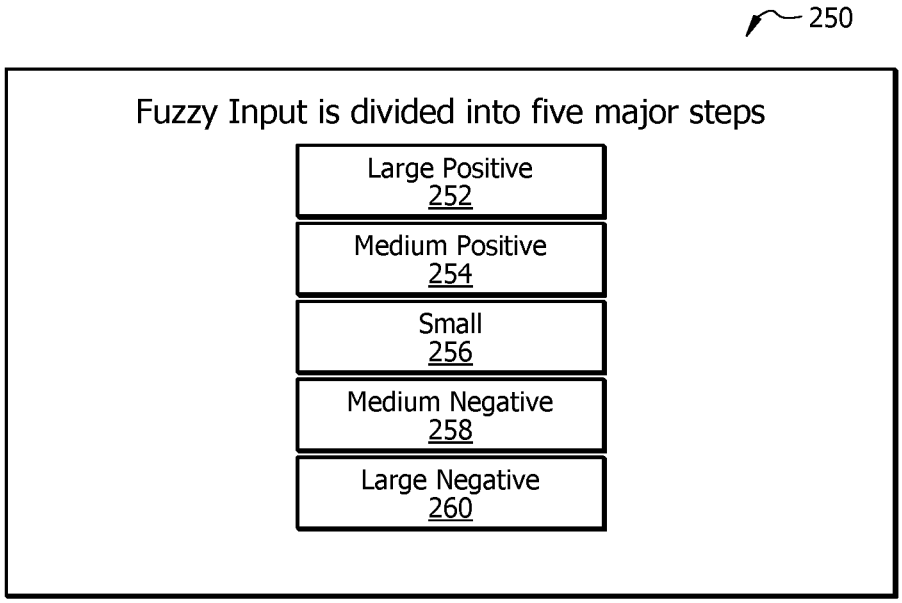
FIG. 2B is an illustration of a fuzzy logic system suitable for integration into an ML architecture according to an embodiment of the disclosure.

Turning now to FIGS. 2A and 2B, a fuzzy logic system 200 is disclosed. The fuzzy logic system 200 enables a fuzzy logic workflow suitable for integration into an ML architecture according to an embodiment of the disclosure. Fuzzy logic is a framework that addresses the uncertainty and imprecision inherent in many real-world decision-making scenarios. Unlike traditional binary logic, which relies on strict true/false values, fuzzy logic allows for degrees of truth between 0 and 1. Such degrees of truth enable more nuanced, human-like reasoning. These characteristics make fuzzy logic well-suited for applications where imprecise data or vague conditions are present. As in certain circumstances sensors monitoring an ESP will generate such data, the fuzzy logic system 200, when integrated with an appropriate trained ML model, is particularly suited for monitoring, detecting a failure within, and generating a failure alert for an operating ESP disposed within a well. By implementing fuzzy sets, membership functions, and linguistic variables, the fuzzy logic system 200 facilitates the modeling of complex relationships between input variables and output decisions, enabling enhanced decision accuracy in situations characterized by the potential uncertainty and vagueness inherent in collecting and interpreting real-world sensor data.

In embodiments of the fuzzy logic system 200, a fuzzifier 210 receives a crisp input 202. In an aspect, a crisp input refers to one or more specific, definite input values that are provided to the system. The crisp input 202 includes at least linguistic variables, numeric values, or a combination thereof. The fuzzifier 210 converts crisp input 202 into at least one fuzzy input set 204. This conversion includes associating at least part of the crisp input 202 with an appropriate membership function of a set of membership functions. These membership functions define the degree to which an input belongs to a particular fuzzy input set 204. At least one of a database or knowledge base contains rules 212. The rules 212 relate the at least one input fuzzy set 204 to an at least one fuzzy output set 206. Each rule is defined in terms of linguistic variables and uses fuzzy logic operators to capture complex relationships between the at least one input fuzzy set 204 and the at least one fuzzy output set 206. In some embodiments, the rules 212 are defined by human subject matter experts during a pre-production or training phase. In other embodiments, the membership functions are defined by human subject matter experts during a pre-production or training phase. In either such embodiment, the subject matter experts are not involved in the post-training or production phase.

An intelligence 214 (in some embodiments, also called an inference engine) evaluates the rules 212 based on the at least one fuzzy input set 204. The intelligence 214 further combines the rules 212 using fuzzy logic operators (e.g., AND, OR, NOT, etc.) to determine the degree to which each of the at least one fuzzy output sets 206 is activated. As part of this determination, each of the at least one fuzzy input sets 204 is assigned a degree of membership in a specific fuzzy output set 206, represented by a spectrum 250. As shown in FIG. 2B, the spectrum 250 accounts for various degrees of membership, arranged in decreasing degree of membership and including but not limited to: a large positive degree 252, a medium positive degree 254, a small degree 256, a medium negative degree 258, and a large negative degree 260. Other embodiments of this disclosure include fewer or greater degrees of membership as best suited to the application space.

A defuzzifier 216 transforms the at least one fuzzy output set 206 into a crisp output 208. The crisp output 208 represents the final decision of the fuzzy logic system 200 regarding the degree to which each of the at least one fuzzy output sets 206 is activated. The final decision is a determination of the most suitable output value or range based on the activated at least one fuzzy output set 206. Thus, when compared to the crisp input 202, the crisp output 208 has an increased likelihood of generating a prediction with a higher degree of accuracy when used as input to a trained ML model.

Figure 3:
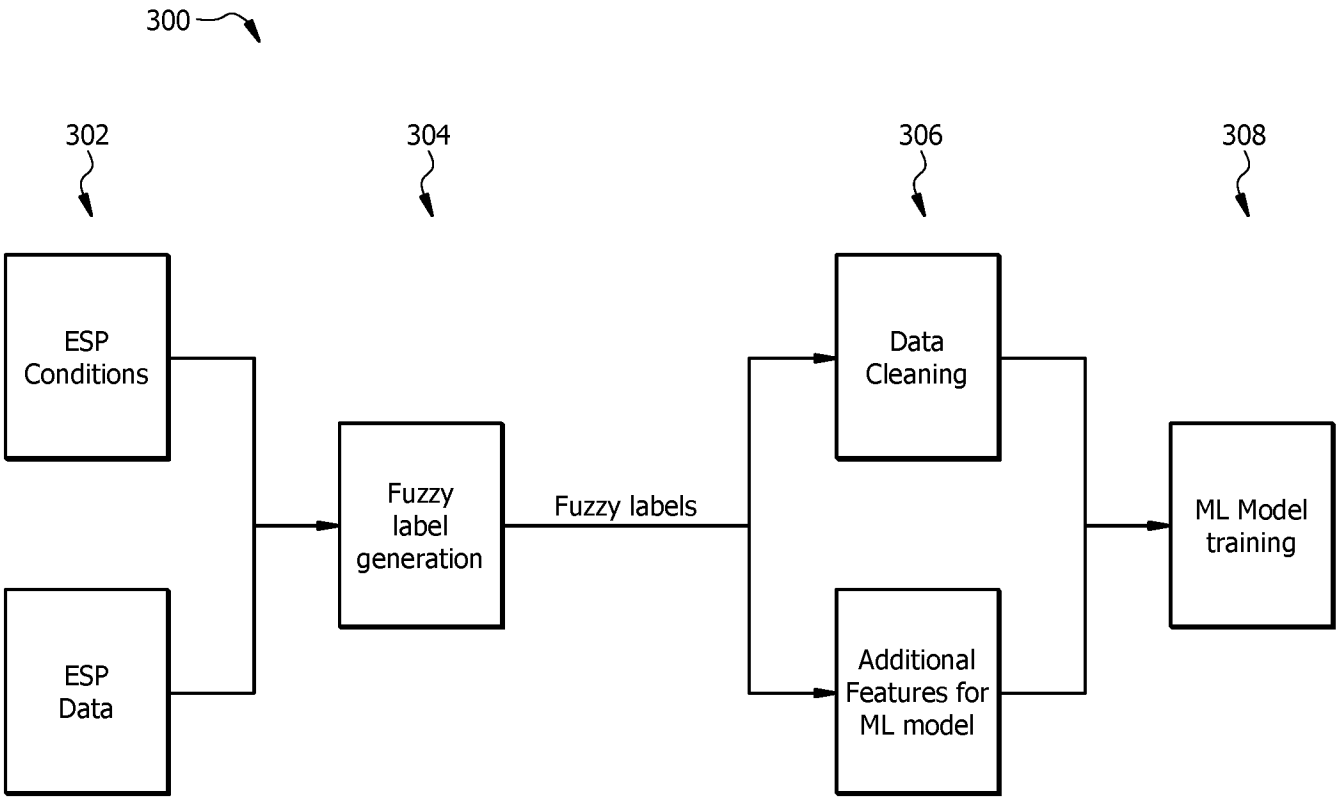
FIG. 3 is an illustration of a process flow for ML model training integrating fuzzy logic according to an embodiment of the disclosure.

Turning now to FIG. 3, a process flow 300 for ML model training integrating fuzzy logic via an end-to-end pipeline according to an embodiment of the disclosure is described. At operation 302, ESP data and ESP conditions, as described below and elsewhere herein, are input. In some embodiments, the input ESP data includes but is not limited to discharge pressure; intake pressure; motor temperature; motor current; and frequency. At operation 304, fuzzy labels are generated using fuzzy logic, with each of the fuzzy labels corresponding to an ESP condition predicted to be present in the ESP. In some such embodiments, the generated fuzzy labels have a value between 0 and 2. At operation 306, the ESP data undergoes data cleaning using at least the generated fuzzy labels. In some embodiments, operation 306 also includes using the fuzzy labels to generate additional features for the ML model to be trained. At operation 308, the ML model is trained. Embodiments implementing the process flow 300 are described in greater detail elsewhere herein.

Turning now to FIG. 4, an exemplary data chart 400 of ESP conditions 450 is described. In embodiments herein, the ESP conditions 450 are indicators of an upcoming failure of an ESP. In some embodiments of the disclosure, the listed ESP conditions 450 are sufficient to enable using a selected machine learning (ML) model to monitor, detect a failure within, and generate a failure alert for an operating ESP disposed within a well as disclosed elsewhere herein. Each of the ESP conditions 450 is associated with a time frame 460. The time frame 460 is the amount of time that incoming data (e.g., data from at least one sensor) is observed to determine whether each of the ESP conditions 450 are presently associated with an ESP being monitored.

As a non-limiting example, observing each following ESP conditions 450 for an associated time frame 460 enables using a selected machine learning (ML) model to monitor, detect a failure within, and generate a failure alert for an operating ESP disposed within a well as disclosed elsewhere herein. In some embodiments, the length of the associated time frame 460 of each of the ESP conditions 450 is configured to reduce false positive detections of each of the ESP conditions 450. In other embodiments, the length of the associated time frame 460 of each of the ESP conditions 450 is configured to have a shorter length based on the measured heightened severity of the associated ESP condition 450. Yet other embodiments include a different set of the ESP conditions 450.

ESP condition 402: Partially closed surface valve during ESP operation, observed for one hour;
ESP condition 404: Pump off, for one hour;
ESP condition 406: Gas lock, for one hour;
ESP condition 408: Pump slow down, for one hour;
ESP condition 410: Emulsion or solid production, for twenty-four hours;
ESP condition 412: Tubing plug, for twenty-four hours;
ESP condition 414: Intake plug, for twenty-four hours;
ESP condition 416: Production fluid density, increase for twenty-four hours;
ESP condition 418: Broken shaft, for thirty minutes;
ESP condition 420: Rotation reversed during operation, for thirty minutes;
ESP condition 422: ADV leak, for one week;
ESP condition 424: Pump wear, for one week;
ESP condition 426: Pump speed up, for one hour; and
ESP condition 428: Open chock, for one hour.

Figure 5:
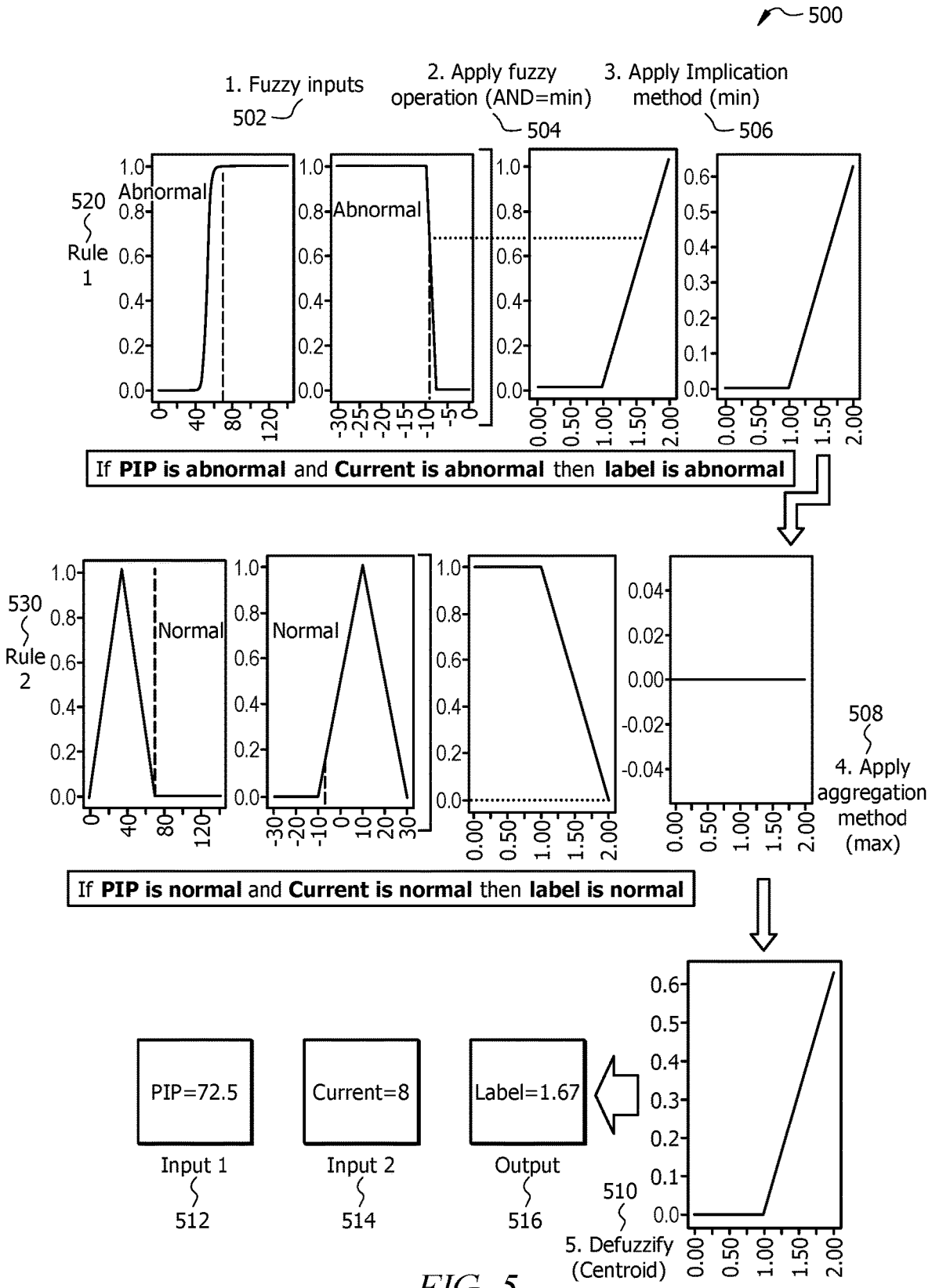
FIG. 5 is an illustration of a fuzzy logic process flow for ESP failure prediction using fuzzy logic according to an embodiment of the disclosure.

Turning now to FIG. 5, a fuzzy logic process flow 500 for ESP failure prediction using fuzzy logic according to an embodiment of the disclosure is described. The process flow 500 is a non-limiting example of using fuzzy logic as described elsewhere herein to assign "normal" or "abnormal" values to labels based on ESP conditions derived from crisp input (e.g., sensor data). In some embodiments, the process flow 500 implements the fuzzy logic system 200 of FIGS. 2A and 2B. As depicted, operations 502 through 510 occur in a sequence. A first rule output 520 and a second rule output 530 are also depicted. These are non-limiting examples of label outputs using the process flow 500.

Inputs are fuzzified at operation 502. A fuzzy logic operation is applied at operation 504. In the example of the process flow 500, the fuzzy logic operation is a fuzzy AND operation. Other embodiments utilize different fuzzy logic operations depending on the implementation. At operation 506, an implication method is applied (e.g., the min operation depicted in FIG. 5), and at operation 508, an aggregation method is applied (e.g., the max operation depicted in FIG. 5) to create a fuzzy output. At operation 510, the fuzzy output is defuzzified into a crisp output. As depicted in FIG. 5, a centroid function is used for defuzzification. Other embodiments utilize different defuzzification functions depending on the implementation.

In light of the foregoing, the first rule output 520 and the second rule output 530 are illustrated as examples of output generated by using the process flow 500 to apply fuzzy logic rules to fuzzified inputs. In the illustrated example, both the first rule output 520 and the second rule output 530 choose what type of label to output based on the value of a pump intake pressure (PIP) 512 input variable of an operational ESP and the value of a measured electrical current 514 input variable of the operational ESP.

The process flow 500 utilizes an all-or-nothing analysis. The first rule output 520 sets an output generated label 516 to normal when both the PIP and current are in normal ranges. The second rule output 530 sets the output generated label 516 to abnormal (indicating a predicted fault) when both the PIP and current are in abnormal ranges. The value of the output generated label 516 is stored as a floating-point number, such that values in a first range (e.g., 0-1 in process flow 500) are associated with a normal range and values in a second range (e.g., 1-2 in process flow 500) are associated with an abnormal range. In other embodiments, the first range and the second range are defined by different starting and ending floating-point number ranges but function as described herein. There is no limitation on the values used so long as normal labels are distinguishable from abnormal labels. The range of values of each label is the domain of the label. The minimum value and the maximum value of each input variable is defined by the observed value(s) of the input variable.

Figure 6:
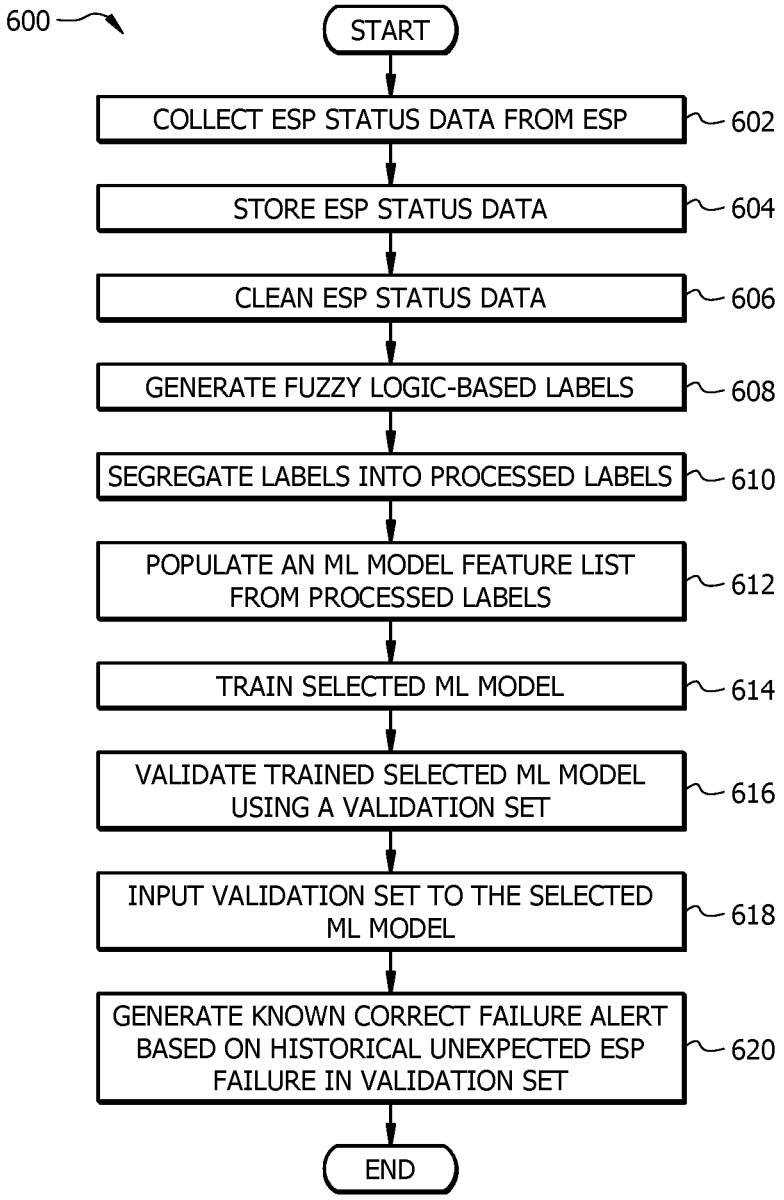
FIG. 6 is a flow diagram illustrating a method for training a selected ML model to monitor, detect a failure within, and generate a failure alert for an operating ESP disposed within a well according to an embodiment of the disclosure.

In accordance with the foregoing, a selected machine learning (ML) model is trainable to monitor, detect a failure within, and generate a failure alert for an operating ESP disposed within a well. Turning now to FIG. 6, a method 600 is described. The method 600 includes, at operation 602, collecting, from at least one sensor associated with the ESP, ESP status data generated during operation of the ESP, which, e.g., may service as crisp input 202 to the fuzzifier 210. The ESP status data includes at least one time series comprising ESP input variables representative of a state of the ESP within the well. In some embodiments, each input variable of the ESP input variables includes a measurement of a physical property of the ESP. In such embodiments, based on the ESP input variables, the state of the ESP indicates at least the ESP being operational, and abnormal data within the ESP status data includes at least a portion of the ESP status data having at least one input variable with an out of bounds value. The out of bounds value indicates an abnormal working condition at a timestamp within the at least one time series. In these embodiments, the ESP input variables include measurements of at least one of a discharge pressure; an intake pressure; a motor temperature; motor current; and frequency. An abnormal working condition as described indicates at least in part that at least one of the measurements of the ESP input variables is out of bounds of a defined acceptable range for the operational ESP.

In some embodiments, the at least one sensor is a SCADA system and at least one ESP input variable of the ESP input variables is data detectable by the SCADA system. In some other embodiments, the at least one sensor is any device or devices configured to collect a time series as described above. At operation 604, the ESP status data is stored.

At operation 606, the method 600 cleans the ESP status data using a fuzzy logic module. The cleaning comprises removing abnormal data from the ESP status data to provide cleaned ESP status data. At operation 608, the method 600 generates, from the cleaned ESP status data, a plurality of fuzzy logic-based labels using the fuzzy logic module. Each fuzzy logic-based label of the plurality of the fuzzy logic-based labels represents an ESP condition associated with the state of the ESP. In some embodiments, each ESP condition of the ESP conditions associated with the state of the ESP indicates a likelihood of the ESP: having a partially closed surface valve during an operation; being off; having a gas lock; having a pump slowdown; experiencing an emulsion or solid production; having a tubing plug; having an intake plug; having a production fluid density increase; having a broken shaft; having a rotation reversed during the operation; having an automatic diverter valve (ADV) leak; exhibiting pump wear; experiencing a pump speed-up; having an open chock; or any combination thereof.

In some such embodiments, generating the plurality of fuzzy logic-based labels further includes applying a plurality of rules to the ESP status data. Each rule of the plurality of rules is associated with at least one of each ESP condition of the plurality of ESP conditions and at least one input variable of the ESP status data. The plurality of rules comprises, for each ESP input variable, a normal value range and an abnormal value range. After applying the plurality of rules to the ESP status data, such embodiments divide the ESP input variables into categories, where each category is associated with one of the ESP conditions, and apply a membership function to each category. For each category, based on an all-or-nothing analysis of an output of the membership function, an output label is assigned to the ESP condition associated with the category. The output label is one of the fuzzy logic-based labels of the plurality of fuzzy logic-based labels and represents the ESP condition.

In some of these embodiments, the all-or-nothing analysis includes, for each output label and each category: assigning an abnormal status to the associated ESP condition when all the ESP input variables in the category are abnormal; assigning a normal status to the associated ESP condition when all the ESP input variables in the category are normal; and discarding the output label associated the category when a first ESP input variable in the category is normal and a second ESP input variable in the category is abnormal. In some such embodiments, all the ESP input variables in the category are determined to be abnormal based on fitting all the ESP input variables in the category to a sigmoid function, and all of the ESP input variables in the category are determined to be normal based on fitting all the ESP input variables in the category to a triangular function.

At operation 610, the method 600 segregates the plurality of fuzzy logic-based labels into a plurality of processed labels. At operation 612, the method 600 populates each ML model feature of an ML model feature list from the plurality of processed labels. In some embodiments, the processing further includes adding additional features to the ML model feature list. The additional features are based on converting at least one label of the plurality of processed labels into an additional feature using a matching fuzzy logic rule associated with one of the ESP conditions.

At operation 614, the method 600 trains the selected ML model using the ML model feature list using training data. In some embodiments, the training data includes a history of historical unexpected ESP failures. Each historical unexpected ESP failure is associated with a historical ESP condition associated with a historical state. The validation set is a subset of the training data.

At operation 616, the method 600 validates the trained selected ML model using a validation set. Validating the trained selected ML model includes inputting the validation set to the selected ML model and generating, from the selected ML model and the validation set, at least one failure alert. The at least one failure alert is known to be correct based on at least one historical unexpected ESP failure included in the validation set. Operation 616 provides a trained and validated selected ML model.

Figure 7:
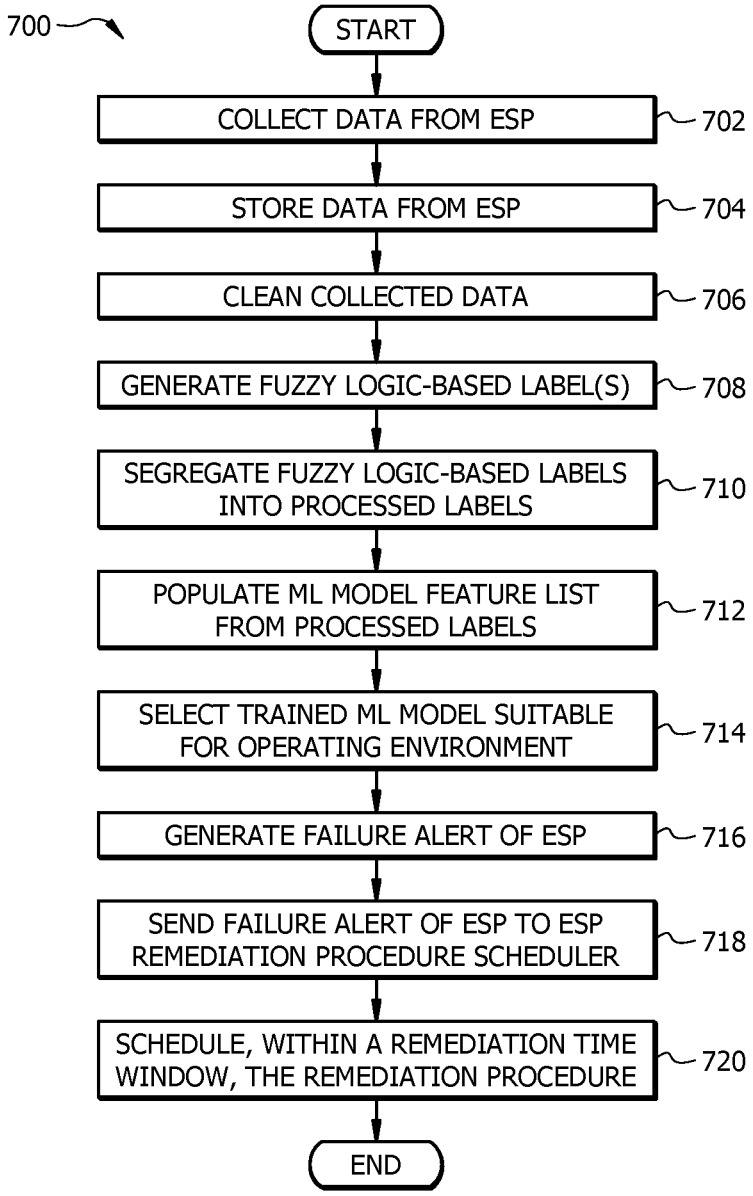
FIG. 7 is a flow diagram illustrating a method for using a trained machine learning (ML) model to monitor, detect a failure within, and schedule a remediation procedure for an operating electric submersible pump (ESP) disposed within a well according to an embodiment of the disclosure.

In accordance with the foregoing, a trained ML model is configured to monitor, detect a failure within, and schedule a remediation procedure for an operating electric submersible pump (ESP) disposed within a well. Turning now to FIG. 7, a method 700 is described. The method 700 includes, at operation 702, collecting, from at least one sensor, ESP status data, which, in some embodiments herein, serves as crisp input 202 to the fuzzifier 210. The ESP status data includes at least one time series comprising ESP input variables representative of a state of the ESP within the well. In some embodiments, each input variable of the ESP input variables includes a measurement of a physical property of the ESP. In such embodiments, based on the ESP input variables, the state of the ESP indicates at least the ESP being operational, and abnormal data within the ESP status data includes at least a portion of the ESP status data having at least one input variable with an out of bounds value. The out of bounds value indicates an abnormal working condition at a timestamp within the at least one time series. In these embodiments, the ESP input variables include measurements of at least one of a discharge pressure; an intake pressure; a motor temperature; motor current; and frequency. An abnormal working condition as described indicates at least in part that at least one of the measurements of the ESP input variables is out of bounds of a defined acceptable range for the operational ESP.

In some embodiments, the at least one sensor is a SCADA system and at least one ESP input variable of the ESP input variables is data detectable by the SCADA system. In some other embodiments, the at least one sensor is any device or devices configured to collect a time series as described above.

At operation 704, the method 700 stores the ESP data. At operation 706, the method 700 cleans the ESP status data using a fuzzy logic module. The cleaning includes removing abnormal data from the ESP status data to provide cleaned ESP status data.

At operation 708, the method 700 generates, from the cleaned ESP status data, a plurality of fuzzy logic-based labels using the fuzzy logic module. Each fuzzy logic-based label of the plurality of the fuzzy logic-based labels represents an ESP condition associated with the state of the ESP. In some embodiments, each ESP condition of the ESP conditions associated with the state of the ESP indicates a likelihood of the ESP: having a partially closed surface valve during an operation; being off; having a gas lock; having a pump slowdown; experiencing an emulsion or solid production; having a tubing plug; having an intake plug; having a production fluid density increase; having a broken shaft; having a rotation reversed during the operation having an automatic diverter valve (ADV) leak; exhibiting pump wear; experiencing a pump speed-up; having an open chock; or any combination thereof.

In some such embodiments, generating the plurality of fuzzy logic-based labels further includes applying a plurality of rules to the ESP status data. Each rule of the plurality of rules is associated with at least one of each ESP condition of the plurality of ESP conditions and at least one input variable of the ESP status data. The plurality of rules comprises, for each ESP input variable, a normal value range and an abnormal value range. After applying the plurality of rules to the ESP status data, such embodiments divide the ESP input variables into categories, where each category is associated with one of the ESP conditions, and apply a membership function to each category. For each category, based on an all-or-nothing analysis of an output of the membership function, an output label is assigned to the ESP condition associated with the category. The output label is one of the fuzzy logic-based labels of the plurality of fuzzy logic-based labels and represents the ESP condition.

In some of these embodiments, the all-or-nothing analysis includes, for each output label and each category: assigning an abnormal status to the associated ESP condition when all the ESP input variables in the category are abnormal; assigning a normal status to the associated ESP condition when all the ESP input variables in the category are normal; and discarding the output label associated the category when a first ESP input variable in the category is normal and a second ESP input variable in the category is abnormal.

At operation 710, the method 700 segregates the plurality of fuzzy logic-based labels into a plurality of processed labels. At operation 712, the method 700 populates each ML model feature of an ML model feature list from the plurality of processed labels. In some embodiments, populating each ML model feature of an ML model feature list further includes adding additional features to the ML model feature list. The additional features are based on converting at least one label of the plurality of processed labels into an additional feature using a matching fuzzy logic rule associated with one of the ESP conditions.

At operation 714, the method 700 selects a trained ML model. The trained ML model is configured to accept the ML model feature list as an input. The trained ML model is selected based on having an improved accuracy for monitoring, detecting the failure within, and scheduling the remediation procedure for the operating ESP disposed within the well. The improved accuracy is based on specific characteristics of the trained ML model, specific characteristics of the well, and specific characteristics of the ESP. In some embodiments, the trained ML model is trained using training data and validated using a validation set. In some such embodiments, the training data includes a history of historical unexpected ESP failures. Each historical unexpected ESP failure is associated with a historical ESP condition associated with a historical state. The validation set is a subset of the training data.

At operation 716, the method 700 generates a failure alert of the ESP, using the trained ML model and based on the ESP status data. At operation 718, the method 700 sends the failure alert of the ESP to an ESP remediation procedure scheduler. At operation 720, the method 700 schedules, within a remediation time window and using the ESP remediation procedure scheduler, the remediation procedure. The remediation time window is before a catastrophic failure of the ESP.

Figure 8:
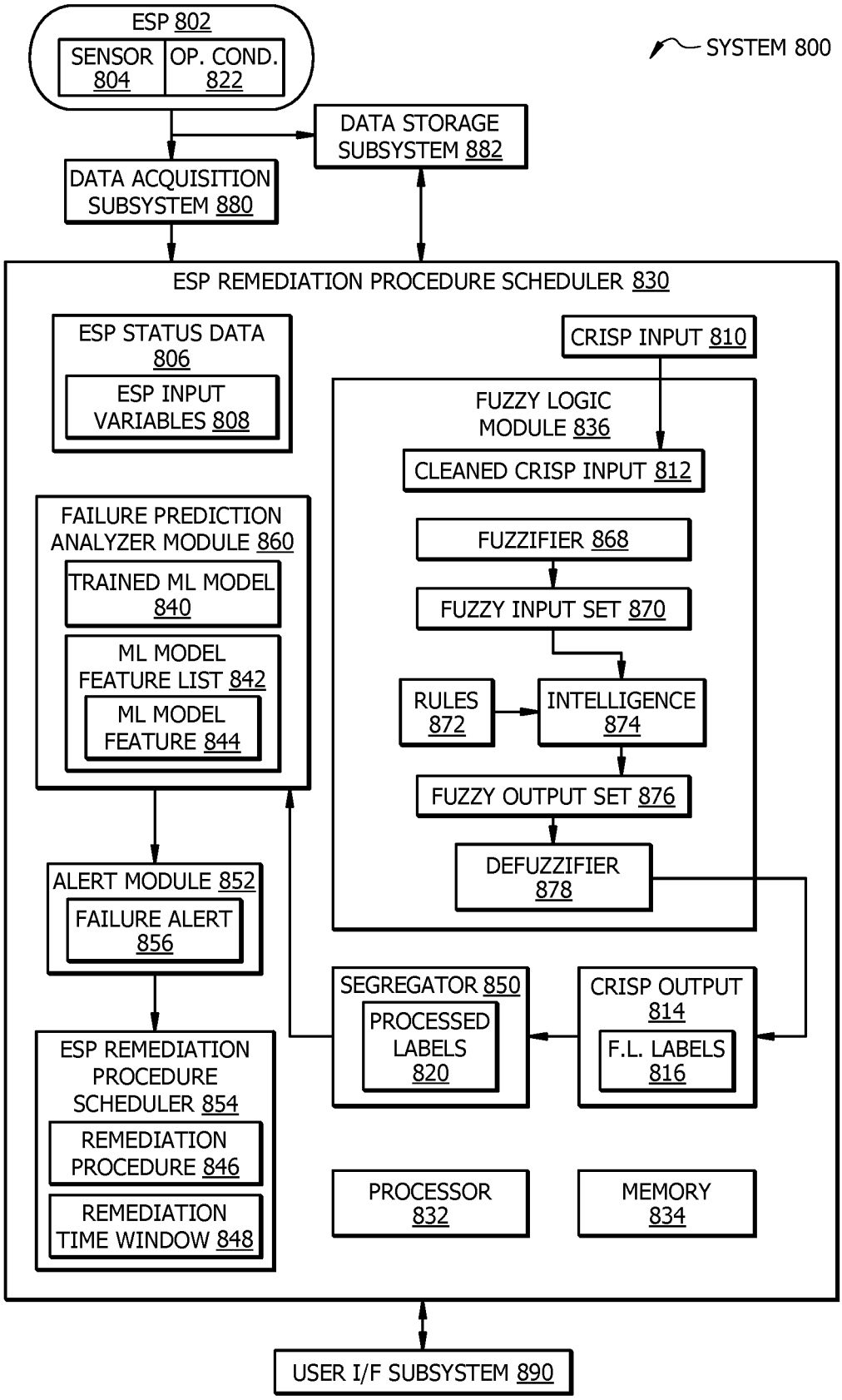
FIG. 8 is a block diagram of a system for using a trained machine learning (ML) model to monitor, detect a failure within, and schedule a remediation procedure for an operating electric submersible pump (ESP) according to an embodiment of the disclosure.

In accordance with the foregoing, a system is configured to monitor, detect a failure within, and schedule a remediation procedure for an operating electric submersible pump (ESP) disposed within a well. Turning now to FIG. 8, a system 800 is described for using a trained ML model 840 to monitor, detect a failure within, and schedule a remediation procedure 846 for an operating ESP 802. The system includes the ESP 802, which is disposed within a well. A data acquisition subsystem 880 is communicatively coupled to at least one sensor 802. The at least one sensor 804 is communicatively coupled to the ESP 802. The at least one sensor is further coupled to a data storage subsystem 882.

An ESP remediation procedure scheduler 830 is configured to monitor the ESP 802. The ESP remediation procedure scheduler 830 includes a processor 832 and a non-transitory memory 834. The ESP remediation procedure scheduler 830 is further configured to collect, using the data acquisition subsystem 880, ESP status data 806. The ESP status data 806 includes at least one time series comprising ESP input variables 808. The ESP input variables 808 are representative of a state of the ESP 802 within the well.

The system 800 stores the ESP status data 806 in the data storage subsystem 882 and converts the ESP status data 806 into crisp input ESP status data 810. The crisp input ESP status data 810 is configured to be a compatible input for fuzzy logic operations. The crisp input ESP status data 810 is cleaned using a fuzzy logic module 836. The fuzzy logic module 836 implements at least the fuzzy logic system 200 of FIGS. 2A and 2B, and includes at least: a fuzzifier 868, a fuzzy input set 870 (e.g., the crisp input ESP status data 810), rules 872, an intelligence 874, a fuzzy output set 876, and a defuzzifier 878. Cleaning the crisp input ESP status data 810 includes removing abnormal data from the crisp input ESP status data to provide cleaned crisp input ESP status data 812.

The system 800 generates, from the cleaned crisp input ESP status data 812 and using the fuzzy logic module 836, a crisp output 814. The crisp output 814 is based at least on the output of the defuzzifier 878, and includes a plurality of fuzzy logic-based labels 816. Each fuzzy logic-based label 816 of the plurality of the fuzzy logic-based labels 816 represents an ESP condition 818 associated with the state of the ESP 802.

Using a segregator 850, the system 800 segregates the plurality of fuzzy logic-based labels 816 into a plurality of processed labels 820. The system 800 then uses a failure prediction analyzer module 850 to populate each ML model feature 844 of an ML model feature list 842 from the plurality of processed labels 820.

Following the population of the ML model feature list 842, the system 800 selects the trained ML model 840. The trained ML model 840 is configured to accept the ML model feature list 842 as an input. The trained ML model 840 is also selected based on having an improved accuracy for monitoring, detecting the failure within, and scheduling the remediation procedure 846 for the operating ESP 802 disposed within the well. The improved accuracy is based on specific characteristics of the trained ML model 840, specific characteristics of the well, and specific characteristics of the ESP 802.

The system 800 further generates, by an alert module 852, a failure alert 856 of the ESP 802. The failure alert 856 is generated using the selected ML model 840 and based on the ESP status data 806 as described above. The system 800 sends, from the alert module 852 to an ESP remediation procedure scheduler 854, the failure alert 856 of the ESP 802. Finally, the system 800 schedules within a remediation time window 848 and using the ESP remediation procedure scheduler 854, the remediation procedure 846. The remediation time window 848 is before a catastrophic failure of the ESP 802.

In some embodiments, the remediation procedure 846 comprises changing, in response to the failure alert 856 of the ESP 802, an operating condition 822 of the ESP 802. In some embodiments, changing the operating condition 822 includes any action that tends to mitigate at least one of each ESP condition 818.

In some such embodiments, the system 800 displays to a user, by way of a graphical display interface, the failure alert 856 of the ESP 802. In some such embodiments, the graphical display interface is incorporated into a user interface system 890. In some embodiments, the graphical display interface receives data from at least one component of system 800 disclosed herein, including but not limited to the ESP 802, the at least one sensor 804, the ESP remediation procedure scheduler 830, the trained ML model 840, the failure prediction analyzer module 850, the alert module 852, the ESP remediation procedure scheduler 854, the fuzzifier 868, the defuzzifier 878, the data acquisition subsystem 880, and the data storage subsystem 882. The graphical display interface forms displays of at least one of the various types of data disclosed herein, including but not limited to the ESP status data 806, ESP input variables 808, the at least one ESP condition 818, the operating condition 822 of the ESP 802, the trained ML model 840, the ML model feature list 842, each ML model feature 844, the remediation procedure 846, the remediation time window 848, and other outputs of the failure prediction analyzer module 850, the alert module 852, and the ESP remediation procedure scheduler 854.

In some embodiments of the foregoing system 800, the trained ML model 840 is trained using training data and validated using a validation set. The training data includes a history of historical unexpected ESP failures each associated with a historical ESP condition associated with a historical state. The validation set is a subset of the training data.

Figure 9:
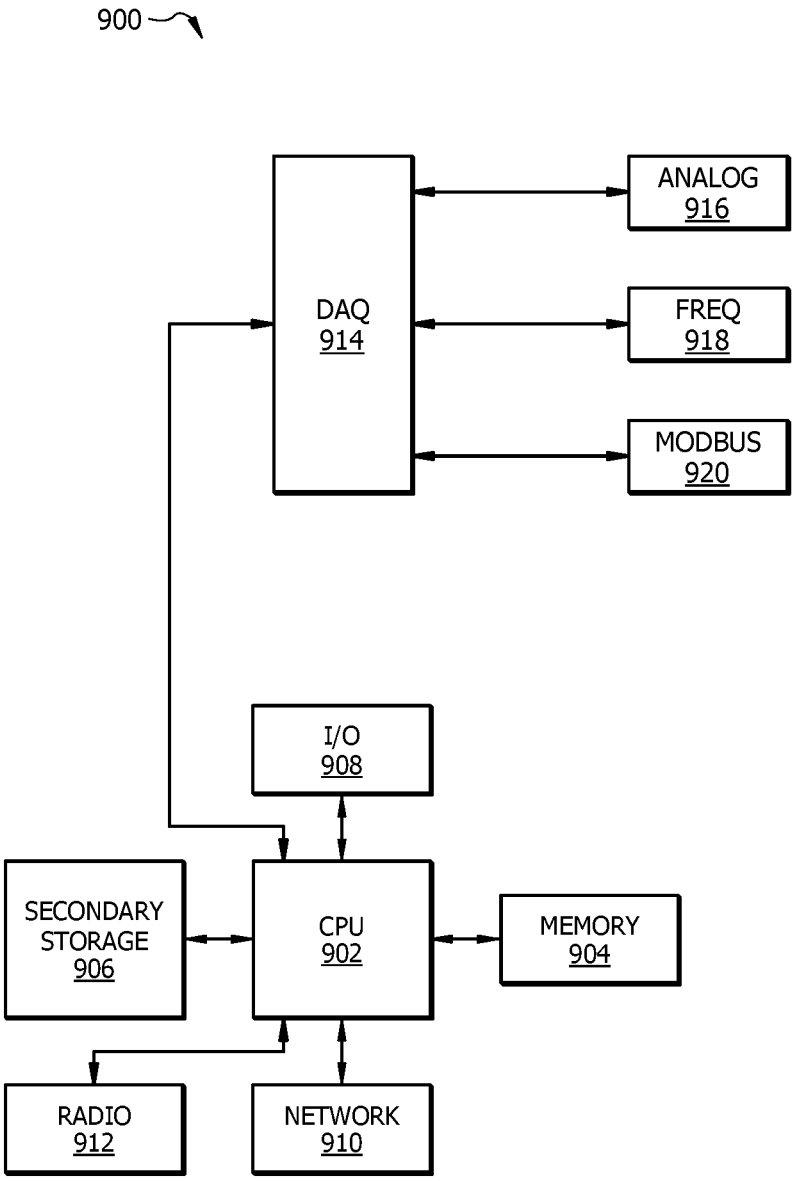
FIG. 9 is a block diagram of a computer system suitable for implementing one or more embodiments of the disclosure.

Turning now to FIG. 9, a computer system 900 according to an embodiment of the disclosure is described. In some embodiments, the computer system 900 is referred to interchangeably as the "unit controller 900." In some embodiments, the computer system 900 is at least one of (or at least a component of) the ESP remediation procedure scheduler 830 of the system 800, the computer system 45 of FIG. 1, or any other computer system or combination of computer systems configured to execute the method 600 or the method 700 described herein. In particular, in some embodiments, the terms unit controller or computer system 900 are interchangeable with the term "ESP remediation procedure scheduler 830." In some embodiments, the computer system 900 is communicatively connected to embodiments of at least one of the ESP 122, the ESP motor 124, blowout preventer 108, control panel 132, a remote terminal unit, or the system 800 as disclosed herein.

Some embodiments of the computer system 900 are suitable for implementing one or more embodiments of a remote computer system, for example, a cloud computing system, a virtual network function (VNF) on a network slice of a cloud computing platform, and a plurality of user devices.

The computer system 900 includes one or more processors 902 (each also referred to as a "central processor unit," "central processing unit," or CPU) that is in communication with a memory 904, a secondary storage 906, input/output devices 908, and network devices 910. Some embodiments of the computer system 900 continuously monitor the state of the input devices and change the state of the output devices based on a plurality of programmed instructions. In some embodiments, the programmed instructions comprise one or more applications retrieved from the memory 904 for executing by the processor 902 in the non-transitory memory 904 within the memory 904. In some embodiments, the input/output devices 908 comprise a Human Machine Interface with a display screen and the ability to receive conventional inputs from a user such as push button, touch screen, keyboard, mouse, or any other such device or element that a user utilizes to input a command to the computer system 900. In some embodiments, the secondary storage 906 comprises at least one of a solid-state memory, a hard drive, or any other type of memory suitable for data storage. In some such embodiments, the secondary storage 906 additionally optionally comprises at least one of removable memory storage devices such as solid-state memory or removable memory media such as magnetic media and optical media (including without limitation compact discs (CDs), digital versatile discs (DVDs), blu-ray (BD) discs, magneto-optical (MO) discs, etc.).

The computer system 900 is configured to communicate with various networks utilizing the network devices 910. In some embodiments, the various networks comprise wired networks utilizing at least one of, e.g., twisted-pair ethernet, direct attach cable (DAC cable), or fiber optic communications equipment, or any other type of wired networking equipment with substantially similar performance characteristics. In other embodiments, the various networks comprise at short range wireless networks such as Wi-Fi (i.e., the IEEE 802.11 family of standards), Bluetooth, or other low power wireless signals such as ZigBee, Z-Wave, 6LoWPan, Thread, and Wi-Fi HaLow, or any other type of wireless networking equipment with substantially similar performance characteristics. In yet other embodiments, the various networks comprise a combination of wired networks and wireless networks as described above. Some embodiments of the computer system 900 include a long-range radio transceiver 912 for communicating with mobile network providers.

In some embodiments, the computer system 900 comprises a data acquisition (DAQ) card 914 for communication with one or more sensors. In some such embodiments, the DAQ card 914 is a standalone system with a microprocessor, memory, and one or more applications executing in memory. In some embodiments, the DAQ card 914, as illustrated, is at least one of a card or a device within the computer system 900. In some embodiments, the DAQ card 914 is combined with the input/output device 908. In some embodiments, the DAQ card 914 receives one or more analog inputs 916, one or more frequency inputs 918, and one or more Modbus inputs 920. For example, the analog input 916 may include a volume sensor, e.g., a tank level sensor. In some examples, the frequency input 918 includes a flow meter, i.e., a fluid system flowrate sensor. In some examples, the modbus input 920 includes a pressure transducer. In some embodiments, the DAQ card 914 converts the signals received via the analog input 916, the frequency input 918, and the modbus input 920 into the corresponding sensor data. For example, some embodiments of the DAQ card 914 convert a frequency input 918 from the flowrate sensor into flow rate data measured in gallons per minute (GPM).

The systems and methods disclosed herein may be advantageously employed in the context of wellbore servicing operations, particularly, in relation to scheduling maintenance of an ESP transmission based on predicting the failure of the ESP transmission as described herein.

In some embodiments, systems and methods disclosed herein, including the method 700 or any process executing on the computer system 900 enables monitoring, detecting a failure within, and scheduling a remediation procedure for an operating ESP disposed within a well. These systems and methods comprise: collecting, from at least one sensor, ESP status data, the ESP status data comprising at least one time series comprising ESP input variables representative of a state of the ESP within the well; storing the ESP status data; cleaning the ESP status data using a fuzzy logic module, the cleaning comprising removing abnormal data from the ESP status data to provide cleaned ESP status data; generating, from the cleaned ESP status data, a plurality of fuzzy logic-based labels using the fuzzy logic module, each fuzzy logic-based label of the plurality of the fuzzy logic-based labels representing an ESP condition associated with the state of the ESP; segregating the plurality of fuzzy logic-based labels into a plurality of processed labels; populating each ML model feature of an ML model feature list from the plurality of processed labels; selecting a trained ML model, the trained ML model being: configured to accept the ML model feature list as an input, and selected based on having an improved accuracy for monitoring, detecting the failure within, and scheduling the remediation procedure for the operating ESP disposed within the well, the improved accuracy based on specific characteristics of the trained ML model, specific characteristics of the well, and specific characteristics of the ESP; generating a failure alert of the ESP, using the trained ML model and based on the ESP status data; sending the failure alert of the ESP to an ESP remediation procedure scheduler; scheduling, within a remediation time window and using the ESP remediation procedure scheduler, the remediation procedure, the remediation time window being before a catastrophic failure of the ESP.

Additional Disclosure

In some embodiments, an ESP includes a multistage centrifugal pump used to induce artificial lift in a well after the natural pressure of the well has fallen too low to allow unaided primary production to continue. Artificial lift includes any process that increases pressure within a reservoir, thus encouraging oil, gas, or other hydrocarbons to rise to the surface. Artificial lift is needed when deposits no longer have sufficient energy or pressure to naturally produce at economic rates using primary production techniques. In other circumstances, artificial lift is also usable to induce early production in hydrocarbon wells.

Embodiments disclosed herein include at least one time series (e.g., the ESP status data of embodiments herein). In such embodiments, the at least one time series has a regular time interval or fixed time interval.

In some embodiments, the ESP conditions are curated by subject matter experts. In other embodiments, the systems and methods disclosed herein are deployed as at least one of software-as-a-service, microservice, or web applications. Such embodiments are deployable, for example, the DS365.ai platform, or on any platform that includes the capability to integrate time series analysis with machine learning and fuzzy logic operations.

In some embodiments, a failure alert includes a predicted date of failure of the ESP. In such embodiments, the remediation time window ends on or before this predicted date, enabling remediation procedures to be performed before the failure of the ESP. In some such embodiments, a user is able to manually adjust the start time and end time of the remediation time window. For example, the start time and end time are adjustable to specific calendar dates.

In some embodiments, failure of an ESP includes but is not limited to the ESP entering a state wherein the ESP is no longer able to produce oil, gas, or other products in paying quantities. In other embodiments, irreversibly shutting down completely. In yet other embodiments, either of the foregoing is a catastrophic failure of the ESP.

In some embodiments, segregation of a plurality of fuzzy logic-based labels includes removing abnormal data points as defined elsewhere herein.

Some embodiments of this disclosure feature at least one abnormal data point (also called "abnormal data" herein). Notwithstanding the foregoing, some embodiments of the abnormal data point include a data point where one or more input variables are not in their normal range. In some such embodiments, abnormal data points arise from ESP conditions including but not limited to the ESP conditions 450 included in the data chart 400 discussed elsewhere herein.

In some embodiments herein, in addition to being for data cleaning as described, fuzzy logic-based labels are also usable as or to generate additional ML features for the ML model. In such embodiments, generation includes concatenating such labels (representing, e.g., ESP conditions described herein) with the ESP input variables (e.g., intake pressure, motor temperature, etc., described herein).

In some embodiments, the ML model is a classifier. In some such embodiments, the selected ML model is a specific classifier chosen for desirable performance characteristics (e.g., increased accuracy versus other tested ML models) based on the results of being tested against a validation set during ML model training.

In some embodiments involving training an ML model, approximately sixty percent of the training data is used to train an ML model. In such embodiments, approximately forty percent of the training data is used as the validation set. In some embodiments containing a volume of training data covering a span of time, an initial period of time (e.g., the first month of operation of an ESP captured in the training data) is ignored by the systems and methods disclosed herein. During this initial period of time, the ESP is stabilizing and the ESP input variable values are inconclusive. In some such embodiments, as the ESP is expected to fail after a set operational lifetime, only the portion of the training data within the set operational lifetime is used. Discarding expected failures from the training data ensures that the ML model is trained to predict unexpected failures.

In some embodiments, the type of ML model chosen influences the margin of error of ESP failure prediction. In these embodiments, a trained ML model is chosen for a specific deployment based on the training data used to train the model being expected to be similar to the ESP input data that will be encountered when the trained ML model is deployed. Types of ML models usable with the disclosure include but are not limited to implementations of supervised, semi-supervised, unsupervised and reinforcement ML models, regression-based models, and classification-based models.

In some such embodiments, the XGBoost classifier is known to be particularly performant. XGBoost is a Python computer language module providing an optimized distributed gradient boosting tree library that is efficient, flexible and portable. XGBoost provides a parallel gradient-boosting tree model and in some embodiments runs on distributed computing environments. Other embodiments employ at least one of the gradient boosted decision tree (GBDT) model or an alternative type of gradient boosting model (GBM).

Embodiments of the disclosed systems and methods provide numerous advantages and improvements over the traditional, contemporary use of trained human experts to predict ESP failure. Such advantages and improvements include but are not limited to (1) increased accuracy in time-until-failure or time-of-failure prediction over prior approaches, leading to reduced downtime and reduced production cost(s); (2) improved worker safety and lessened environmental impacts in part due to reducing the occurrence of catastrophic ESP failures; and (3) reducing unnecessary ESP maintenance by using ML-based failure prediction to schedule ESP maintenance as described herein.

The following are non-limiting, specific embodiments in accordance with the present disclosure:

A first embodiment, which is a method for training a selected machine learning (ML) model to monitor, detect a failure within, and generate a failure alert for an operating electric submersible pump (ESP) disposed within a well, the method comprising: collecting, from at least one sensor associated with the ESP, ESP status data generated during operation of the ESP, the ESP status data comprising at least one time series comprising ESP input variables representative of a state of the ESP within the well; storing the ESP status data; cleaning the ESP status data using a fuzzy logic module, the cleaning comprising removing abnormal data from the ESP status data to provide cleaned ESP status data; generating, from the cleaned ESP status data, a plurality of fuzzy logic-based labels using the fuzzy logic module, each fuzzy logic-based label of the plurality of the fuzzy logic-based labels representing an ESP condition associated with the state of the ESP; segregating the plurality of fuzzy logic-based labels into a plurality of processed labels; populating each ML model feature of an ML model feature list from the plurality of processed labels; training the selected ML model using the ML model feature list using training data; and validating the trained selected ML model using a validation set to provide a trained and validated selected ML model; wherein validating comprises: inputting the validation set to the selected ML model, and generating, from the selected ML model and the validation set, at least one failure alert, the at least one failure alert known to be correct based on at least one historical unexpected ESP failure included in the validation set.

A second embodiment, which is the method of the first embodiment, wherein the at least one sensor comprises a SCADA system and at least one ESP input variable of the ESP input variables is data detectable by the SCADA system.

A third embodiment, which is the method of the first embodiment, wherein each input variable of the ESP input variables comprises a measurement of a physical property of the ESP; based on the ESP input variables, the state of the ESP indicates at least the ESP being operational; and abnormal data comprises at least a portion of the ESP status data having at least one input variable with an out of bounds value, the out of bounds value indicating an abnormal working condition at a timestamp within the at least one time series.

A fourth embodiment, which is the method of the third embodiment, wherein the ESP input variables comprise measurements of at least one of a discharge pressure; an intake pressure; a motor temperature; motor current; and frequency.

A fifth embodiment, which is the method of the first embodiment, wherein each ESP condition of the ESP conditions associated with the state of the ESP indicates a likelihood of the ESP: having a partially closed surface valve during an operation; being off; having a gas lock; having a pump slowdown; experiencing an emulsion or solid production; having a tubing plug; having an intake plug;

having a production fluid density increase; having a broken shaft; having a rotation reversed during the operation; having an automatic diverter valve (ADV) leak; exhibiting pump wear; experiencing a pump speed-up; having an open chock; or any combination thereof.

A sixth embodiment, which is the method of the fifth embodiment, wherein generating the plurality of fuzzy logic-based labels further comprises: applying a plurality of rules to the ESP status data, each rule of the plurality of rules associated with at least one of each ESP condition of the plurality of ESP conditions and at least one input variable of the ESP status data, the plurality of rules comprising, for each ESP input variable, a normal value range and an abnormal value range; dividing the ESP input variables into categories, each category associated with one of the ESP conditions; applying a membership function to each category; and for each category, based on an all-or-nothing analysis of an output of the membership function, assign an output label to the ESP condition associated with the category, the output label being one of the fuzzy logic-based labels of the plurality of fuzzy logic-based labels representing the ESP condition.

A seventh embodiment, which is the method of the sixth embodiment, wherein the all-or-nothing analysis comprises, for each output label and each category: assigning an abnormal status to the associated ESP condition when all the ESP input variables in the category are abnormal; assigning a normal status to the associated ESP condition when all the ESP input variables in the category are normal; and discarding the output label associated the category when a first ESP input variable in the category is normal and a second ESP input variable in the category is abnormal.

An eighth embodiment, which is the method of the seventh embodiment, further comprising: all the ESP input variables in the category being abnormal based on fitting all the ESP input variables in the category to a sigmoid function; and all the ESP input variables in the category being normal based on fitting all the ESP input variables in the category to a triangular function.

A ninth embodiment, which is the method of the first embodiment, wherein: the training data comprises a history of historical unexpected ESP failures each associated with a historical ESP condition associated with a historical state, and the validation set is a subset of the training data; and populating each ML model feature of an ML model feature list further comprises adding additional features to the ML model feature list, the additional features based on converting at least one label of the plurality of processed labels into an additional feature using a matching fuzzy logic rule associated with one of the ESP conditions.

A tenth embodiment, a method for using a trained machine learning (ML) model to monitor, detect a failure within, and schedule a remediation procedure for an operating electric submersible pump (ESP) disposed within a well, the method comprising: collecting, from at least one sensor, ESP status data, the ESP status data comprising at least one time series comprising ESP input variables representative of a state of the ESP within the well; storing the ESP status data; cleaning the ESP status data using a fuzzy logic module, the cleaning comprising removing abnormal data from the ESP status data to provide cleaned ESP status data; generating, from the cleaned ESP status data, a plurality of fuzzy logic-based labels using the fuzzy logic module, each fuzzy logic-based label of the plurality of the fuzzy logic-based labels representing an ESP condition associated with the state of the ESP; segregating the plurality of fuzzy logic-based labels into a plurality of processed labels; populating each ML model feature of an ML model feature list from the plurality of processed labels; selecting a trained ML model, the trained ML model being: configured to accept the ML model feature list as an input, and selected based on having an improved accuracy for monitoring, detecting the failure within, and scheduling the remediation procedure for the operating ESP disposed within the well, the improved accuracy based on specific characteristics of the trained ML model, specific characteristics of the well, and specific characteristics of the ESP; generating a failure alert of the ESP, using the trained ML model and based on the ESP status data; sending the failure alert of the ESP to an ESP remediation procedure scheduler; and scheduling, within a remediation time window and using the ESP remediation procedure scheduler, the remediation procedure, the remediation time window being before a catastrophic failure of the ESP.

An eleventh embodiment, which is the method of the tenth embodiment, wherein the at least one sensor comprises a SCADA system and at least one ESP input variable of the ESP input variables is data detectable by the SCADA system.

A twelfth embodiment, which is the method of the tenth embodiment, wherein each input variable of the ESP input variables comprises a measurement of a physical property of the ESP; based on the ESP input variables, the state of the ESP indicates at least the ESP being operational; and abnormal data comprises at least a portion of the ESP status data having at least one input variable with an out of bounds value, the out of bounds value indicating an abnormal working condition at a timestamp within the at least one time series.

A thirteenth embodiment, which is the method of the twelfth embodiment, wherein the ESP input variables comprise measurements of at least one of a discharge pressure; an intake pressure; a motor temperature; motor current; and frequency.

A fourteenth embodiment, which is the method of the tenth embodiment, wherein each ESP condition of the ESP conditions associated with the state of the ESP indicates a likelihood of the ESP: having a partially closed surface valve during an operation; being off; having a gas lock; having a pump slowdown; experiencing an emulsion or solid production; having a tubing plug; having an intake plug; having a production fluid density increase; having a broken shaft; having a rotation reversed during the operation having an automatic diverter valve (ADV) leak; exhibiting pump wear; experiencing a pump speed-up; having an open chock; or any combination thereof.

A fifteenth embodiment, which is the method of the fourteenth embodiment, wherein generating the plurality of fuzzy logic-based labels further comprises: applying a plurality of rules to the ESP status data, each rule of the plurality of rules associated with at least one of each ESP condition of the plurality of ESP conditions and at least one input variable of the ESP status data, the plurality of rules comprising, for each ESP input variable, a normal value range and an abnormal value range; dividing the ESP input variables into categories, each category associated with one of the ESP conditions; applying a membership function to each category; and for each category, based on an all-or-nothing analysis of an output of the membership function, assign an output label to the ESP condition associated with the category, the output label being one of the fuzzy logic-based labels of the plurality of fuzzy logic-based labels representing the ESP condition.

A sixteenth embodiment, which is the method of the fifteenth embodiment, wherein the all-or-nothing analysis comprises, for each output label and each category: assigning an abnormal status to the associated ESP condition when all the ESP input variables in the category are abnormal; assigning a normal status to the associated ESP condition when all the ESP input variables in the category are normal; and discarding the output label associated the category when a first ESP input variable in the category is normal and a second ESP input variable in the category is abnormal.

A seventeenth embodiment, which is the method of the tenth embodiment, wherein: the trained ML model having been trained using training data and validated using a validation set, the training data comprising a history of historical unexpected ESP failures each associated with a historical ESP condition associated with a historical state, and the validation set being a subset of the training data; and populating each ML model feature of an ML model feature list further comprises adding additional features to the ML model feature list, the additional features based on converting at least one label of the plurality of processed labels into an additional feature using a matching fuzzy logic rule associated with one of the ESP conditions.

An eighteenth embodiment, which is a system for using a trained machine learning (ML) model to monitor, detect a failure within, and schedule a remediation procedure for an operating electric submersible pump (ESP), the system comprising: the ESP being disposed within a well; a data acquisition subsystem communicatively coupled to at least one sensor communicatively coupled to the ESP, and further coupled to a data storage subsystem; an ESP remediation procedure scheduler configured to monitor the ESP comprising a processor and a non-transitory memory, and further configured to: collect, using the data acquisition subsystem, ESP status data, the ESP status data comprising at least one time series comprising ESP input variables representative of a state of the ESP within the well; store the ESP status data in the data storage subsystem; convert the ESP status data into crisp input ESP status data; clean the crisp input ESP status data using a fuzzy logic module, the cleaning comprising removing abnormal data from the crisp input ESP status data to provide cleaned crisp input ESP status data; generate, from the cleaned crisp input ESP status data and using the fuzzy logic module, a crisp output comprising a plurality of fuzzy logic-based labels, each fuzzy logic-based label of the plurality of the fuzzy logic-based labels representing an ESP condition associated with the state of the ESP; using a segregator, segregate the plurality of fuzzy logic-based labels into a plurality of processed labels; using a failure prediction analyzer module: populate each ML model feature of an ML model feature list from the plurality of processed labels; select the trained ML model, the trained ML model being: configured to accept the ML model feature list as an input, and selected based on having an improved accuracy for monitoring, detecting the failure within, and scheduling the remediation procedure for the operating ESP disposed within the well, the improved accuracy based on specific characteristics of the trained ML model, specific characteristics of the well, and specific characteristics of the ESP; generate, by an alert module, a failure alert of the ESP, using the selected ML model and based on the ESP status data; send, from the alert module to an ESP remediation procedure scheduler, the failure alert of the ESP; and schedule, within a remediation time window and using the ESP remediation procedure scheduler, the remediation procedure, the remediation time window being before a catastrophic failure of the ESP.

A nineteenth embodiment, which is the system of the eighteenth embodiment, wherein: the trained ML model having been trained using training data and validated using a validation set, the training data comprising a history of historical unexpected ESP failures each associated with a historical ESP condition associated with a historical state, and the validation set being a subset of the training data; and populating each ML model feature of an ML model feature list further comprises adding additional features to the ML model feature list, the additional features based on converting at least one label of the plurality of processed labels into an additional feature using a matching fuzzy logic rule associated with one of the ESP conditions.

A twentieth embodiment, which is the system of the eighteenth embodiment, wherein: the remediation procedure comprises changing, in response to the failure alert of the ESP, an operating condition of the ESP; and further comprising displaying to a user, by way of a graphical display interface, the failure alert of the ESP.

A twenty-first embodiment, which is a method comprising: collecting, from at least one sensor associated with an electric submersible pump (ESP) disposed within a well, ESP status data generated during operation of the ESP; cleaning the ESP status data using a fuzzy logic module (e.g., fuzzifying the ESP status data) to provide cleaned ESP status data; and using the cleaned ESP status data to train a machine learning model (ML) configured to generate an alert regarding an unexpected ESP failure, inputting the cleaned ESP status data into a trained machine learning (ML) model configured to generate an alert regarding an unexpected ESP failure, or both.

A twenty-second embodiment, which is a system comprising: an electric submersible pump (ESP) disposed within a well; a data acquisition subsystem communicatively coupled to at least one sensor communicatively coupled to the ESP and configured to collect ESP status data generated during operation of the ESP; and an ESP controller comprising a processor and a memory and configured to: collect the ESP status data; clean the ESP status data using a fuzzy logic module (e.g., fuzzifying the ESP status data) to provide cleaned ESP status data; and use the cleaned ESP status data to train a machine learning model (ML) configured to generate an alert regarding an unexpected ESP failure, input the cleaned ESP status data into a trained machine learning (ML) model configured to generate an alert regarding an unexpected ESP failure, or both.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 9 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 90 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 90 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A method for training a selected machine learning (ML) model to monitor, detect a failure within, and generate a failure alert for an operating electric submersible pump (ESP) disposed within a well, the method comprising:

collecting, from at least one sensor associated with the ESP, ESP status data generated during operation of the ESP, the ESP status data comprising at least one time series comprising ESP input variables representative of a state of the ESP within the well;

storing the ESP status data;

cleaning the ESP status data using a fuzzy logic module, the cleaning comprising removing abnormal data from the ESP status data to provide cleaned ESP status data;

generating, from the cleaned ESP status data, a plurality of fuzzy logic-based labels using the fuzzy logic module, each fuzzy logic-based label of the plurality of the fuzzy logic-based labels representing an ESP condition associated with the state of the ESP;

segregating the plurality of fuzzy logic-based labels into a plurality of processed labels;

populating each ML model feature of an ML model feature list from the plurality of processed labels;

training the selected ML model using the ML model feature list using training data; and validating the trained selected ML model using a validation set to provide a trained and validated selected ML model;

wherein validating comprises:

inputting the validation set to the selected ML model, and generating, from the selected ML model and the validation set, at least one failure alert, the at least one failure alert known to be correct based on at least one historical unexpected ESP failure included in the validation set.

2. The method of claim 1, wherein the at least one sensor comprises a supervisory control and data acquisition (SCADA) system and at least one ESP input variable of the ESP input variables is data detectable by the SCADA system.

3. The method of claim 1, wherein:

each input variable of the ESP input variables comprises a measurement of a physical property of the ESP;

based on the ESP input variables, the state of the ESP indicates at least the ESP being operational; and abnormal data comprises at least a portion of the ESP status data having at least one input variable with an out of bounds value, the out of bounds value indicating an abnormal working condition at a timestamp within the at least one time series.

4. The method of claim 3, wherein the ESP input variables comprise measurements of at least one of a discharge pressure; an intake pressure; a motor temperature; motor current; and frequency.

5. The method of claim 1, wherein each ESP condition of the ESP conditions associated with the state of the ESP indicates a likelihood of the ESP: having a partially closed surface valve during an operation; being off, having a gas lock; having a pump slowdown; experiencing an emulsion or solid production; having a tubing plug; having an intake plug; having a production fluid density increase; having a broken shaft; having a rotation reversed during the operation; having an automatic diverter valve (ADV) leak; exhibiting pump wear; experiencing a pump speed-up; having an open chock; or any combination thereof.

6. The method of claim 5, wherein generating the plurality of fuzzy logic-based labels further comprises:

applying a plurality of rules to the ESP status data, each rule of the plurality of rules associated with at least one of each ESP condition of the plurality of ESP conditions and at least one input variable of the ESP status data, the plurality of rules comprising, for each ESP input variable, a normal value range and an abnormal value range;

dividing the ESP input variables into categories, each category associated with one of the ESP conditions;

applying a membership function to each category; and for each category, based on an all-or-nothing analysis of an output of the membership function, assign an output label to the ESP condition associated with the category, the output label being one of the fuzzy logic-based labels of the plurality of fuzzy logic-based labels representing the ESP condition.

7. The method of claim 6, wherein the all-or-nothing analysis comprises, for each output label and each category:

assigning an abnormal status to the associated ESP condition when all the ESP input variables in the category are abnormal;

assigning a normal status to the associated ESP condition when all the ESP input variables in the category are normal; and discarding the output label associated the category when a first ESP input variable in the category is normal and a second ESP input variable in the category is abnormal.

8. The method of claim 7, further comprising:

all the ESP input variables in the category being abnormal based on fitting all the ESP input variables in the category to a sigmoid function; and all the ESP input variables in the category being normal based on fitting all the ESP input variables in the category to a triangular function.

9. The method of claim 1, wherein:

the training data comprises a history of historical unexpected ESP failures each associated with a historical ESP condition associated with a historical state, and the validation set is a subset of the training data; and populating each ML model feature of an ML model feature list further comprises adding additional features to the ML model feature list, the additional features based on converting at least one label of the plurality of processed labels into an additional feature using a matching fuzzy logic rule associated with one of the ESP conditions.

10. A method for using a trained machine learning (ML) model to monitor, detect a failure within, and schedule a remediation procedure for an operating electric submersible pump (ESP) disposed within a well, the method comprising:

collecting, from at least one sensor, ESP status data, the ESP status data comprising at least one time series comprising ESP input variables representative of a state of the ESP within the well;

storing the ESP status data;

cleaning the ESP status data using a fuzzy logic module, the cleaning comprising removing abnormal data from the ESP status data to provide cleaned ESP status data;

generating, from the cleaned ESP status data, a plurality of fuzzy logic-based labels using the fuzzy logic module, each fuzzy logic-based label of the plurality of the fuzzy logic-based labels representing an ESP condition associated with the state of the ESP;

segregating the plurality of fuzzy logic-based labels into a plurality of processed labels;

populating each ML model feature of an ML model feature list from the plurality of processed labels;

selecting a trained ML model, the trained ML model being:

configured to accept the ML model feature list as an input, and selected based on having an improved accuracy for monitoring, detecting the failure within, and scheduling the remediation procedure for the operating ESP disposed within the well, the improved accuracy based on specific characteristics of the trained ML model, specific characteristics of the well, and specific characteristics of the ESP;

generating a failure alert of the ESP, using the trained ML model and based on the ESP status data;

sending the failure alert of the ESP to an ESP remediation procedure scheduler; and scheduling, within a remediation time window and using the ESP remediation procedure scheduler, the remediation procedure, the remediation time window being before a catastrophic failure of the ESP.

11. The method of claim 10, wherein the at least one sensor comprises a supervisory control and data acquisition (SCADA) system and at least one ESP input variable of the ESP input variables is data detectable by the SCADA system.

12. The method of claim 10, wherein:

each input variable of the ESP input variables comprises a measurement of a physical property of the ESP;

based on the ESP input variables, the state of the ESP indicates at least the ESP being operational; and abnormal data comprises at least a portion of the ESP status data having at least one input variable with an out of bounds value, the out of bounds value indicating an abnormal working condition at a timestamp within the at least one time series.

13. The method of claim 12, wherein the ESP input variables comprise measurements of at least one of a discharge pressure; an intake pressure; a motor temperature; motor current; and frequency.

14. The method of claim 10, wherein each ESP condition of the ESP conditions associated with the state of the ESP indicates a likelihood of the ESP: having a partially closed surface valve during an operation; being off, having a gas lock; having a pump slowdown;

experiencing an emulsion or solid production; having a tubing plug; having an intake plug;

having a production fluid density increase; having a broken shaft; having a rotation reversed during the operation having an automatic diverter valve (ADV) leak; exhibiting pump wear;

experiencing a pump speed-up; having an open chock; or any combination thereof.

15. The method of claim 14, wherein generating the plurality of fuzzy logic-based labels further comprises:

applying a plurality of rules to the ESP status data, each rule of the plurality of rules associated with at least one of each ESP condition of the plurality of ESP conditions and at least one input variable of the ESP status data, the plurality of rules comprising, for each ESP input variable, a normal value range and an abnormal value range;

dividing the ESP input variables into categories, each category associated with one of the ESP conditions;

applying a membership function to each category; and for each category, based on an all-or-nothing analysis of an output of the membership function, assign an output label to the ESP condition associated with the category, the output label being one of the fuzzy logic-based labels of the plurality of fuzzy logic-based labels representing the ESP condition.

16. The method of claim 15, wherein the all-or-nothing analysis comprises, for each output label and each category:

assigning an abnormal status to the associated ESP condition when all the ESP input variables in the category are abnormal;

assigning a normal status to the associated ESP condition when all the ESP input variables in the category are normal; and discarding the output label associated the category when a first ESP input variable in the category is normal and a second ESP input variable in the category is abnormal.

17. The method of claim 10, wherein:

the trained ML model having been trained using training data and validated using a validation set, the training data comprising a history of historical unexpected ESP failures each associated with a historical ESP condition associated with a historical state, and the validation set being a subset of the training data; and populating each ML model feature of an ML model feature list further comprises adding additional features to the ML model feature list, the additional features based on converting at least one label of the plurality of processed labels into an additional feature using a matching fuzzy logic rule associated with one of the ESP conditions.

18. A system for using a trained machine learning (ML) model to monitor, detect a failure within, and schedule a remediation procedure for an operating electric submersible pump (ESP), the system comprising:

the ESP being disposed within a well;

a data acquisition subsystem communicatively coupled to at least one sensor communicatively coupled to the ESP, and further coupled to a data storage subsystem;

an ESP remediation procedure scheduler configured to monitor the ESP comprising a processor and a non-transitory memory, and further configured to:

collect, using the data acquisition subsystem, ESP status data, the ESP status data comprising at least one time series comprising ESP input variables representative of a state of the ESP within the well;

store the ESP status data in the data storage subsystem;

convert the ESP status data into crisp input ESP status data;

clean the crisp input ESP status data using a fuzzy logic module, the cleaning comprising removing abnormal data from the crisp input ESP status data to provide cleaned crisp input ESP status data;

generate, from the cleaned crisp input ESP status data and using the fuzzy logic module, a crisp output comprising a plurality of fuzzy logic-based labels, each fuzzy logic-based label of the plurality of the fuzzy logic-based labels representing an ESP condition associated with the state of the ESP;

using a segregator, segregate the plurality of fuzzy logic-based labels into a plurality of processed labels;

using a failure prediction analyzer module:

populate each ML model feature of an ML model feature list from the plurality of processed labels;

select the trained ML model, the trained ML model being:

configured to accept the ML model feature list as an input, and selected based on having an improved accuracy for monitoring, detecting the failure within, and scheduling the remediation procedure for the operating ESP disposed within the well, the improved accuracy based on specific characteristics of the trained ML model, specific characteristics of the well, and specific characteristics of the ESP;

generate, by an alert module, a failure alert of the ESP, using the selected ML model and based on the ESP status data;

send, from the alert module to an ESP remediation procedure scheduler, the failure alert of the ESP; and schedule, within a remediation time window and using the ESP remediation procedure scheduler, the remediation procedure, the remediation time window being before a catastrophic failure of the ESP.

19. The system of claim 18, wherein:

the trained ML model having been trained using training data and validated using a validation set, the training data comprising a history of historical unexpected ESP failures each associated with a historical ESP condition associated with a historical state, and the validation set being a subset of the training data; and populating each ML model feature of an ML model feature list further comprises adding additional features to the ML model feature list, the additional features based on converting at least one label of the plurality of processed labels into an additional feature using a matching fuzzy logic rule associated with one of the ESP conditions.

20. The system of claim 18, wherein:

the remediation procedure comprises changing, in response to the failure alert of the ESP, an operating condition of the ESP; and further comprising displaying to a user, by way of a graphical display interface, the failure alert of the ESP.

* * * * *